US006870112B2

(12) United States Patent
Bresciani et al.

(10) Patent No.: US 6,870,112 B2
(45) Date of Patent: Mar. 22, 2005

(54) LOW-VOLTAGE CIRCUIT BREAKER

(75) Inventors: Nicola Bresciani, Bergamo (IT); Roberto Rota Martir, Brembate Sopra (IT)

(73) Assignee: ABB Service S.r.l., Milan (IT)

( * ) Notice: Subject to any disclaimer, the term of this patent is extended or adjusted under 35 U.S.C. 154(b) by 0 days.

(21) Appl. No.: 10/494,305

(22) PCT Filed: Oct. 30, 2002

(86) PCT No.: PCT/EP02/12166

§ 371 (c)(1),
(2), (4) Date: May 3, 2004

(87) PCT Pub. No.: WO03/041105

PCT Pub. Date: May 15, 2003

(65) Prior Publication Data

US 2004/0262137 A1 Dec. 30, 2004

(30) Foreign Application Priority Data

Nov. 6, 2001 (IT) ..... MI2001A2325

(51) Int. Cl.[7] ..... H01H 1/22
(52) U.S. Cl. ..... 200/244; 200/400; 335/16
(58) Field of Search ..... 200/244, 400, 200/401, 239, 250; 335/16

(56) References Cited

U.S. PATENT DOCUMENTS 4,562,419 A 12/1985 Preuss et al.
4,910,485 A * 3/1990 Bolongeat-Mobleu et al. ... 335/195
5,313,180 A 5/1994 Vial et al.
5,539,167 A * 7/1996 Hood et al. ..... 200/244
6,259,048 B1 7/2001 Castonguay et al.
6,262,642 B1 * 7/2001 Bauer ..... 335/16
6,403,901 B1 * 6/2002 Boeder et al. ..... 200/244

FOREIGN PATENT DOCUMENTS

EP 0 889 498 A2 1/1999
EP 0 889 498 A3 6/1999

* cited by examiner

*Primary Examiner*—K. Lee
(74) *Attorney, Agent, or Firm*—Connolly Bove Lodge & Hutz LLP; Myron K. Wyche

(57) ABSTRACT

A low-voltage circuit breaker, comprising: a rotating contact supporting shaft, is provided with a seat that accommodates the central body of a moving contact so that the first arm protrudes externally from the seat, at least one first spring and one second spring being furthermore arranged in the contact supporting shaft and being suitable to ensure, when the circuit breaker is closed, an adequate contact pressure between the active surface and the fixed contact; the particularity of the circuit breaker consisting of the fact that a first pivot is fixed to the contact supporting shaft and is coupled to a hole formed in the central body, engagement means and at least one second pivot being furthermore arranged on the shaft on mutually opposite sides with respect to the first pivot, the second pivot being movable with respect to the shaft and to the moving contact, the first and second springs being furthermore anchored to the second pivot and to the engagement means and being arranged along two opposite sides of the arm of the moving contact, the second pivot interacting functionally with the first cam-like surface so as to generate a mechanical moment that matches the direction of rotation of the moving contact during at least one portion of the step for separation of the active surface from the fixed contact in a short-circuit condition.

9 Claims, 5 Drawing Sheets

LOW-VOLTAGE CIRCUIT BREAKER

The present invention relates to a low-voltage circuit breaker, i.e., with operating voltages up to 1000 volts.

Low-voltage industrial electrical systems characterized by high currents and power levels normally use specific devices, commonly known in the art as automatic power circuit breakers.

These circuit breakers are designed so as to provide a series of features required to ensure the correct operation of the electrical system in which they are inserted and of the loads connected to it. For example, they: —ensure the nominal current required for the various users; —allow correct insertion and disconnection of the loads with respect to the circuit; —protect the loads against abnormal events such as overloading and short-circuits by opening the circuit automatically; —allow to disconnect the protected circuit by galvanic separation or by means of the opening of suitable contacts in order to achieve full isolation of the load with respect to the electric power source.

Currently, these circuit breakers are available according to various industrial embodiments, the most common of which entrusts the opening of the contacts to complicated kinematic mechanisms actuated by the mechanical energy stored beforehand in special opening springs.

In certain operating conditions, particularly when the presumed short-circuit current can assume significantly high values, the use of devices that utilize in a traditional manner the energy that can be accumulated in the opening springs can be scarcely efficient and uneconomical for opening the contacts; in such cases, it is common to resort to special types of automatic circuit breaker that have technical solutions aimed at increasing their breaking capacity.

Two technical solutions, among those most widely used nowadays, are often used in combination. In particular, a first solution forces the current to follow a given path, so that when a short circuit occurs, electrodynamic repulsion forces occur between the contacts. These repulsion forces generate a useful thrust that helps to increase the separation speed of the moving contacts with respect to the fixed contacts; in this manner, the intervention time is reduced and the presumed short-circuit current is prevented from reaching its maximum value.

The second solution doubles the fixed contacts and the moving contacts. In this case, the flow of current is interrupted in each pole of the circuit breaker in two separate regions that are arranged electrically in series to each other, so that each region is subjected to a lower mechanical and thermal stress.

A particularly critical aspect of known types of circuit breaker is the fact that the presence of electrodynamic repulsion forces, despite contributing positively to the generation of the thrust useful for contact separation, helps the moving contact structure to reach the end of its stroke at high speed and therefore with great energy, this aspect tends to cause violent impacts against the case of the circuit breaker, to the point of requiring the possible use of additional cushioning elements, and may cause bouncing of the moving contacts toward the fixed contacts and undesirable restrikes of the electric arc.

To contrast this possibility, some known solutions use additional systems for latching the moving contacts in the open position; in other known solutions, the structure of the moving contacts and of the functional elements associated therewith is instead configured appropriately so that during the separation stroke of the contacts the moving contacts are slowed. An example in this regard is given in EP 0560697.

Another critical aspect of known types of circuit breaker with double contacts is the need to have, for each pole, a mechanical pressure that is equally distributed on the two surfaces for the coupling between each fixed contact and the corresponding moving contact. If the contact pressure is distributed unevenly, there are in fact negative drawbacks on the electrical conductivity of the circuit breaker, which degrades continuously over the useful life due to the gradual but irregular wear of the conducting plates located on the couplings surfaces of the contacts.

To solve this problem, a currently used solution entails providing the structure that supports the moving contacts and connects them to the actuation element, which structure is generally constituted by a rotating shaft or bar, with degrees of freedom with respect to said actuation element and therefore also with respect to the fixed contacts. Additional springs are furthermore associated with the structure of each moving contact and, by utilizing the freedom of motion of the moving contacts with respect to the fixed contacts and to the actuation element, facilitate the self-adaptation of the moving contact surfaces with respect to the fixed ones and the uniform distribution of contact pressure. An example in this regard is given in EP0314540. In this case, the presence of the additional springs, despite allowing adequate distribution of contact pressures, by virtue of the return action applied by them, might facilitate the possibility of bouncing of the contacts and consequent restriking of the electric arc.

The aim of the present invention is to provide a low-voltage circuit breaker that allows optimum execution of the electrical switching operations, allowing in particular to eliminate or at least minimize the possibility that in short-circuit conditions the moving contact bounces toward the fixed one, with consequent restriking of the electric arc, with a constructive structure that is simple and functionally effective and does not require additional latching elements during opening.

This aim and other objects that will become better apparent hereinafter are achieved by a low-voltage circuit breaker, comprising:

at least one first fixed contact which is electrically connected to a terminal for connection to an electric circuit;

a rotating moving contact, which comprises a central body from which at least one first arm protrudes, an active surface being provided at the end of said first arm said active surface being associable/separable with respect to said fixed contact by means of a rotation of said moving contact, at least one first cam-like surface being formed on said central body, a rotating contact supporting shaft, which is functionally connected to an actuation mechanism of the circuit breaker and is provided with a seat that accommodates the central body of the moving contact so that the first arm protrudes externally from said seat, at least one first spring and one second spring being furthermore arranged in said contact supporting shaft and being suitable to ensure, when the circuit breaker is closed, an adequate contact pressure between said active surface and the fixed contact; characterized in that a first pivot is fixed to said contact supporting shaft and is coupled to a hole formed in said central body, engagement means and at least one second pivot being furthermore arranged on said shaft on mutually opposite sides with respect to the first pivot, said second pivot being movable with respect to the shaft and to the moving contact, said first and second springs being furthermore anchored to the second pivot and to the engagement means and being arranged along two opposite sides of the arm of the moving contact, said second pivot interacting functionally with said first cam-like surface so as to generate a mechanical moment that matches the direction of rotation of the moving contact during at least one portion of the step for separation of the active surface from the fixed contact in a short-circuit condition.

In this manner, circuit breaker according to the invention has the great advantage that during the separation of the parts in mutual contact following a short-circuit, a moment is generated which facilitates the movement of the active surface of the moving contact away from the corresponding fixed contact and contrasts any bouncing thereof, avoiding or minimizing the possibility of restrikes of the electric arc.

Further characteristics and advantages of the invention will become better clear from the description of preferred but not exclusive embodiments of the circuit breaker according to the invention, illustrated only by way of non-limitative example in the accompanying drawings, wherein.

Figure 1:
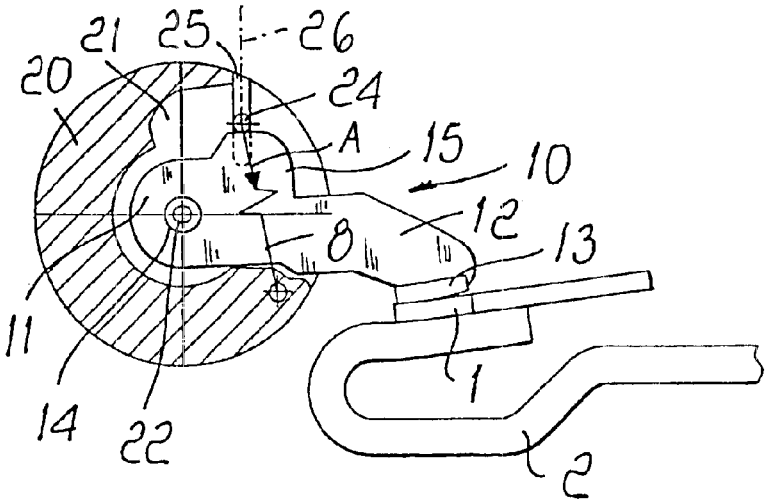
FIG. 1 is a plan view of a first embodiment of the assembly constituted by the contact supporting shaft, the moving contact with a single arm, and a fixed contact, which can be used in the circuit breaker according to the invention, in the position in which the circuit breaker is closed and the contacts are coupled.

In the following description, for the sake of greater simplicity, reference is made to a single pole of the circuit breaker, without thereby intending to limit in any way the scope of the invention, since the conceived solution can be applied to all the poles of a low-voltage circuit breaker having any number of poles. Moreover, in the various figures identical reference numerals designate identical or technically equivalent elements.

With reference to the cited figures, a pole of the low-voltage circuit breaker according to the invention generally comprises at least one first fixed contact 1 that is connected electrically, by means of an appropriately configured conductor 2, to a terminal for connection to an electric circuit, according to embodiments that are widely known in the art and are therefore not described in detail. The pole furthermore comprises a rotating moving contact 10 and a rotating contact supporting shaft 20, which is shown in cross-section in FIGS. 1 to 5 for the sake of greater clarity of illustration and is functionally connected to the moving contact 10 and to a circuit breaker actuation mechanism. Said actuation mechanism, which generally comprises a spring-operated kinematic mechanism, allows connecting functionally the contact supporting shaft 20 to a lever for the manual actuation of the circuit breaker. The embodiment of the actuation mechanism, as well as the methods for functional connection to the manual actuation lever and to the shaft 20, are also widely known in the art and therefore are not shown in the figures.

As shown in detail in FIGS. 1 to 5, the rotating shaft 20 has a seat 21 in which a first pivot 22 is arranged; said pivot is rigidly fixed to said shaft.

In turn, the moving contact 10 has a contoured central body 11, from which at least one first arm 12 protrudes. A first active surface 13, for example a contact plate or pad, is arranged at the end of said arm and can be coupled/separated electrically with respect to the fixed contact 1 following the rotation of said moving contact 10; furthermore, a hole 14 and at least one first cam-like surface 15 are formed in the central body 11.

Advantageously, in the circuit breaker according to the invention the moving contact 10 is arranged so that the central body 11 is accommodated in the seat 21 and so that the arm 12 protrudes transversely externally to said seat, and is functionally connected to the shaft 20 by coupling the hole 14 to the pivot 22. Furthermore, at least one second pivot 24 and an engagement means are used on the shaft 20. Said second pivot is arranged so that it can move with respect to the shaft 20 and to the moving contact 10 itself and is suitable to interact functionally with the first cam-like surface 15, and the engagement means is preferably a third pivot 23, which is fixed to the shaft 20 for the purposes that will become better apparent hereinafter. With respect to a lateral view of the moving contact 10, said pivots 23 and 24 are arranged on mutually opposite sides relative to the pivot 22 and therefore also relative to the body of said moving contact.

In particular, in the embodiment show in FIG. 1 the second pivot 24 is coupled to the shaft 20 so that it can slide with respect to it, with its ends inserted in slots 25 (only one of which is shown in FIG. 1) formed in the shaft 20; in the specific case shown, the slots 25 have a rectilinear axis 26 and are arranged so that the axes 26 are mutually parallel. As an alternative, said slots might be arranged and/or configured differently, for example configured so as to trace a curved line.

Figure 2:
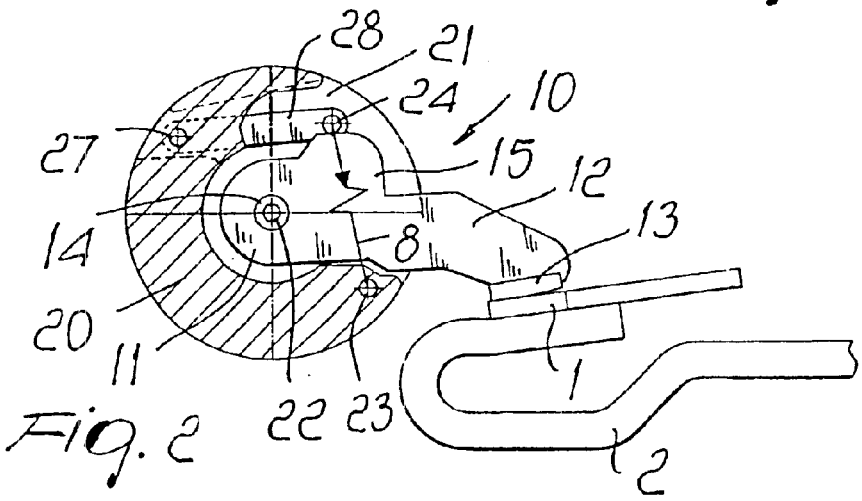
FIG. 2 is a plan view of a second embodiment of the assembly constituted by the contact supporting shaft, the moving contact with a single arm, and a fixed contact, which can be used in the circuit breaker according to the invention.
Figure 3:
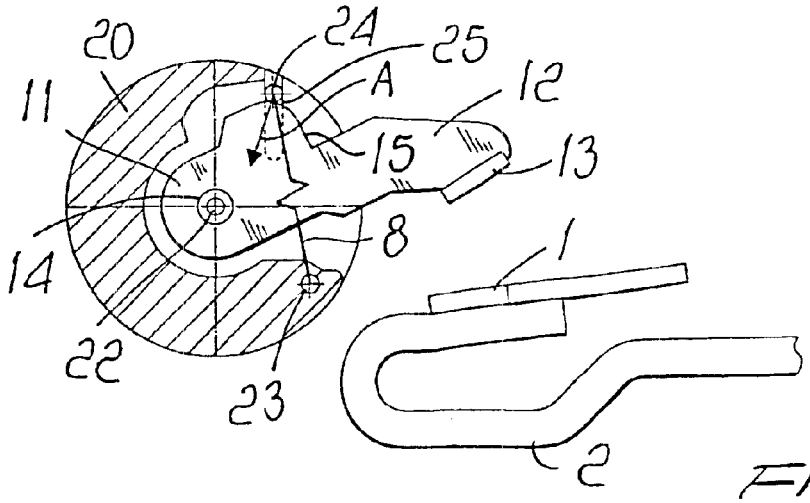
FIGS. 3 to 5 are plan views of successive positions of the moving contact of FIG. 1 during the separation of the active surface from the fixed contact following a short circuit.
Figure 4:
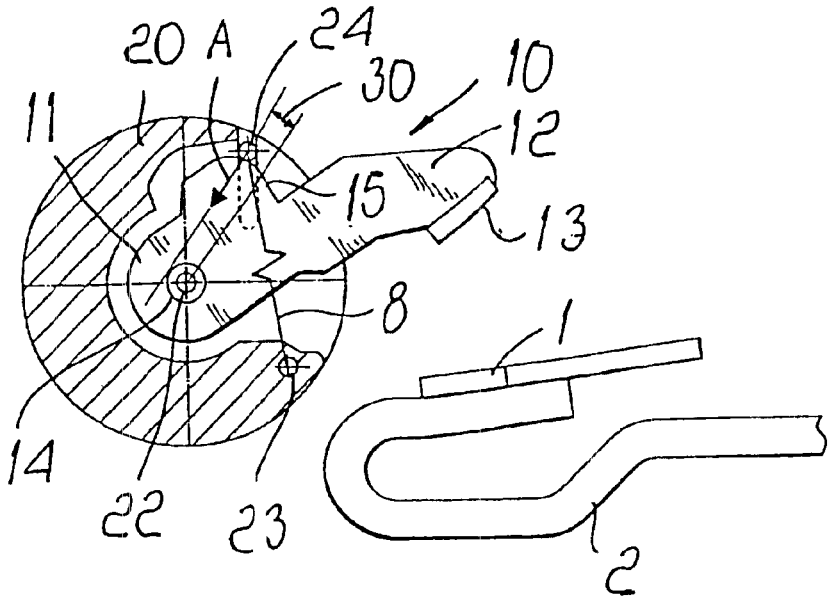
Figure 5:
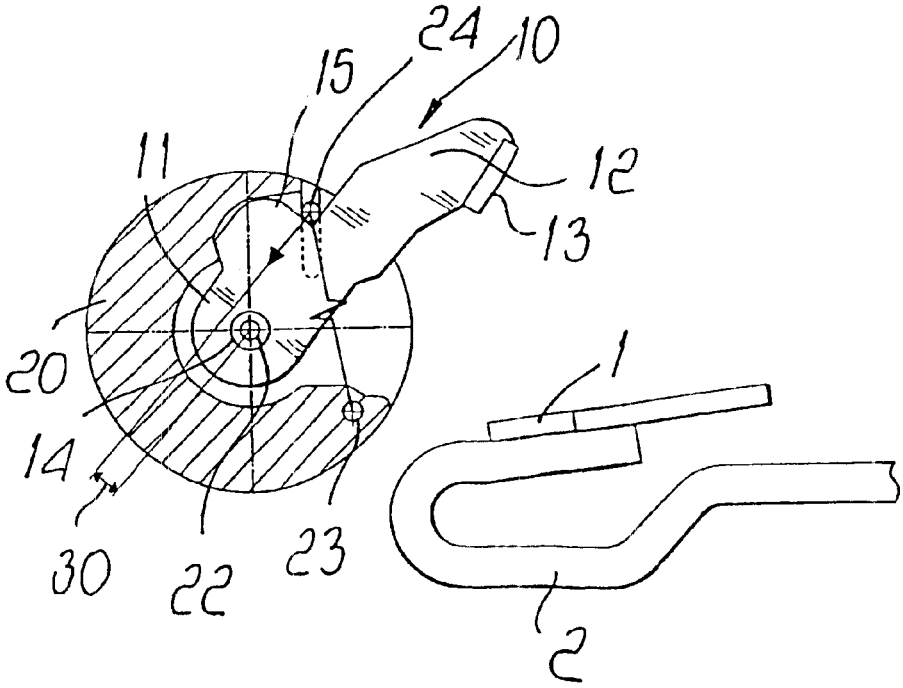

A second embodiment shown in FIG. 2 instead uses an additional fourth pivot 33, which, using the first pivot 22 as reference, is fixed to the shaft 20 in a substantially symmetrical position with respect to the third pivot 23; in turn, the second pivot 24 is connected to the fourth pivot 33 by virtue of two linkages 28 (only one of which is shown in FIG. 2), which are arranged in the seat 21 of the shaft 20 along two opposite sides of the moving contact 10, which are substantially parallel to each other.

Finally, on the contact supporting shaft 10 there are at least two springs that are functionally associated with the moving contact 10 and are suitable to ensure, when the circuit breaker is closed, an adequate contact pressure between the active surface 13 and the corresponding fixed contact 1. In particular, the circuit breaker according to the invention preferably uses at least two traction springs 8 (only one of which is visible in FIGS. 1 to 5), each spring being anchored to the second pivot 24 and to the third pivot 23 and being arranged on mutually opposite sides with respect to the arm 12 of the moving contact 10.

It should be noted that in the various embodiments the fixed pivot 23 (or optionally, in the case of FIG. 2, also the fourth fixed pivot 27), can be replaced in a fully equivalent manner by engagement means that allow the engagement of the ends of the springs 8 in a manner that is functionally similar to the function provided by the single fixed pivot 23; for example, it is possible to use two smaller pivots that are structurally mutually independent and fixed to the shaft, or two coupling elements coupled to the shaft, or two seats formed therein and suitable to allow the anchoring of the ends of the springs 8, or other means, so long as they are compatible with the application.

The operation of the pole of the circuit breaker according to the invention during a separation of the contacts following a short circuit is now described with particular reference, by way of example, to the embodiment shown in FIGS. 1 and 3 to 5.

Figure 6:
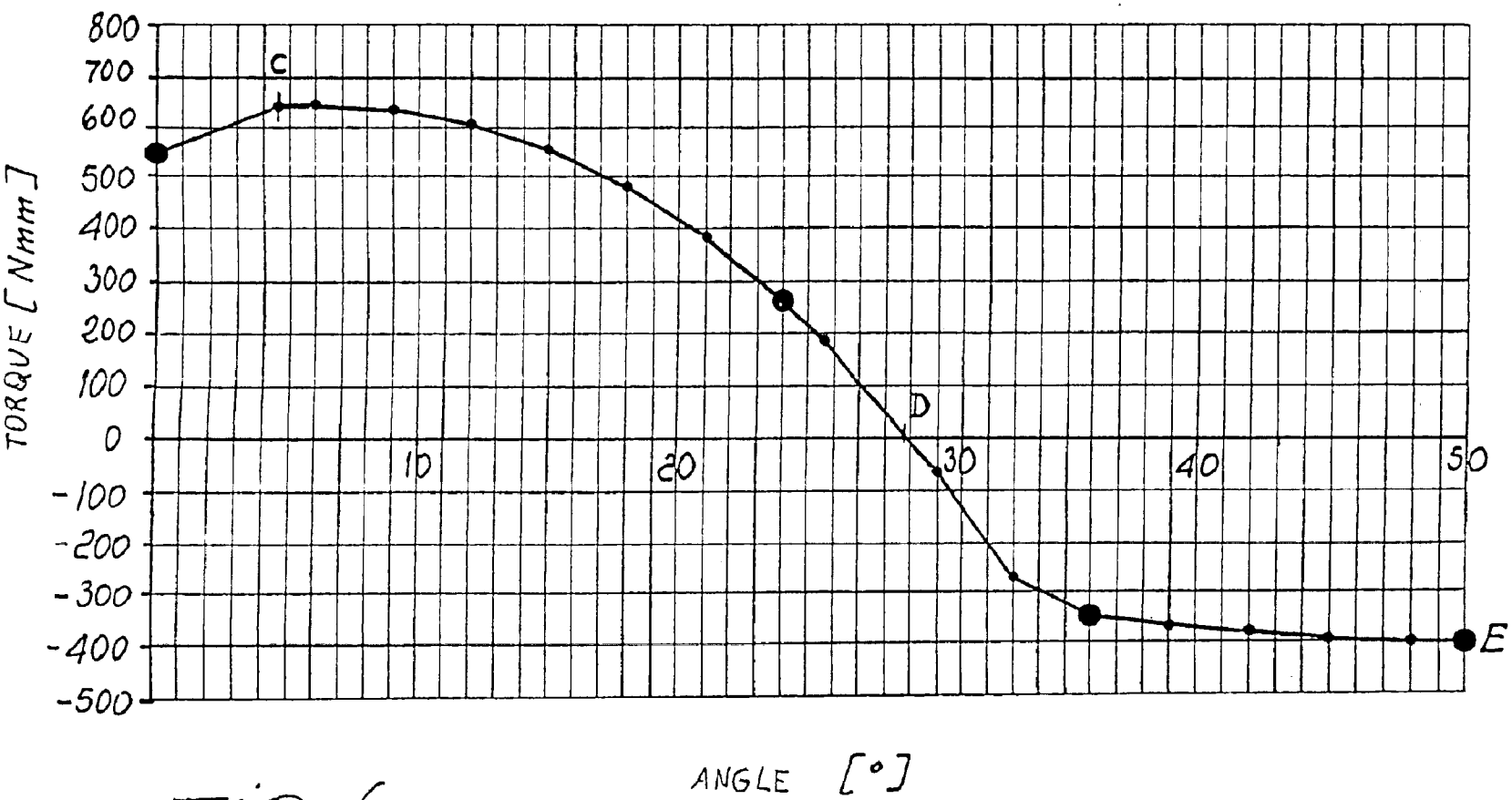
FIG. 6 is a qualitative chart that plots the torque that acts, in the circuit breaker according to the invention, on the moving contact during the separation of the contacts caused by a short circuit, as a function of the rotation angle of said moving contact with respect to the contact supporting shaft.

In a condition in which the circuit breaker is closed and the contacts are coupled, shown in FIG. 1, the second pivot 24, under the action of the corresponding springs associated therewith, is arranged in abutment against the wall of the cam-like surface 15, and by interacting with it facilitates the generation of a force, indicated by the arrow A, that produces a moment that lends to keep the active surface 13 of the moving contact 10 coupled to the fixed contact 1. In this way, the active surface 13 is adequately pressed against the fixed contact 1. In this condition, the moment that acts on the moving contact 10 corresponds to the point C indicated in FIG. 6. When a short circuit occurs, the electrodynamic repulsion forces generated in the electrical parts crossed by the current trigger the rotation of the moving contact 10 under the restraint of the pivot 24. In particular, in the embodiment of FIGS. 1 and 3 to 5, the pivot 24 slides in the slots 25, and the springs 8 associated therewith are elongated. In the embodiment of FIG. 2, instead, the pivot 24, again associated with the springs 8, moves along circular arcs under the restraint of the pair of linkages 28 that connect it to the corresponding pivot 27. In both cases, in this initial step shown in FIG. 3 the pivot 24, under the action of the springs, interacts with the cam-like surface 15, remaining in direct contact thereon, with mutual sliding of the parts in contact. This leads to a variation in the direction of the force A, with gradual decrease of its lever arm 30 with respect to the pivot 22 and therefore, as shown in FIG. 6, to a reduction in the moment that acts on the contact 10 that contrasts its rotation. As rotation continues, the line of action of the force A passes through the pivot, reducing the corresponding lever arm 30 to zero, and accordingly reducing to zero the moment that is applied to the contact 10; this condition is shown by the point D in the chart of FIG. 6. Subsequently, as shown sequentially in FIGS. 4 and 5, the pivot-cam interaction is such as to place the line of action of the force A below center with respect to the pivot 22, and therefore the lever arm 30 has the opposite sign with respect to the initial step. In this second region, which corresponds in FIG. 6 to the portion of the chart comprised between points D and E, there is therefore a mechanical moment that advantageously matches the direction of rotation of the contact 10.

This provides the great benefit of having, over at least one portion of the contact separation maneuver, a moment that facilitates the movement of the active surface of the moving contact away from the fixed contact and contrasts any bouncing of said moving contact, preventing the possibility of restriking the electric arc. Furthermore, this moment helps to permanently keep the contact 10 in the position it has reached, shown in FIG. 5, making it unnecessary to use additional latching systems.

The solutions described above for a single-contact circuit breaker can be implemented easily and just as advantageously in the case of circuit breakers with double contacts; in such cases it is in fact substantially sufficient to replicate, symmetrically with respect to the rotation axis, the shape and the functional parts of the invention.

Figure 7:
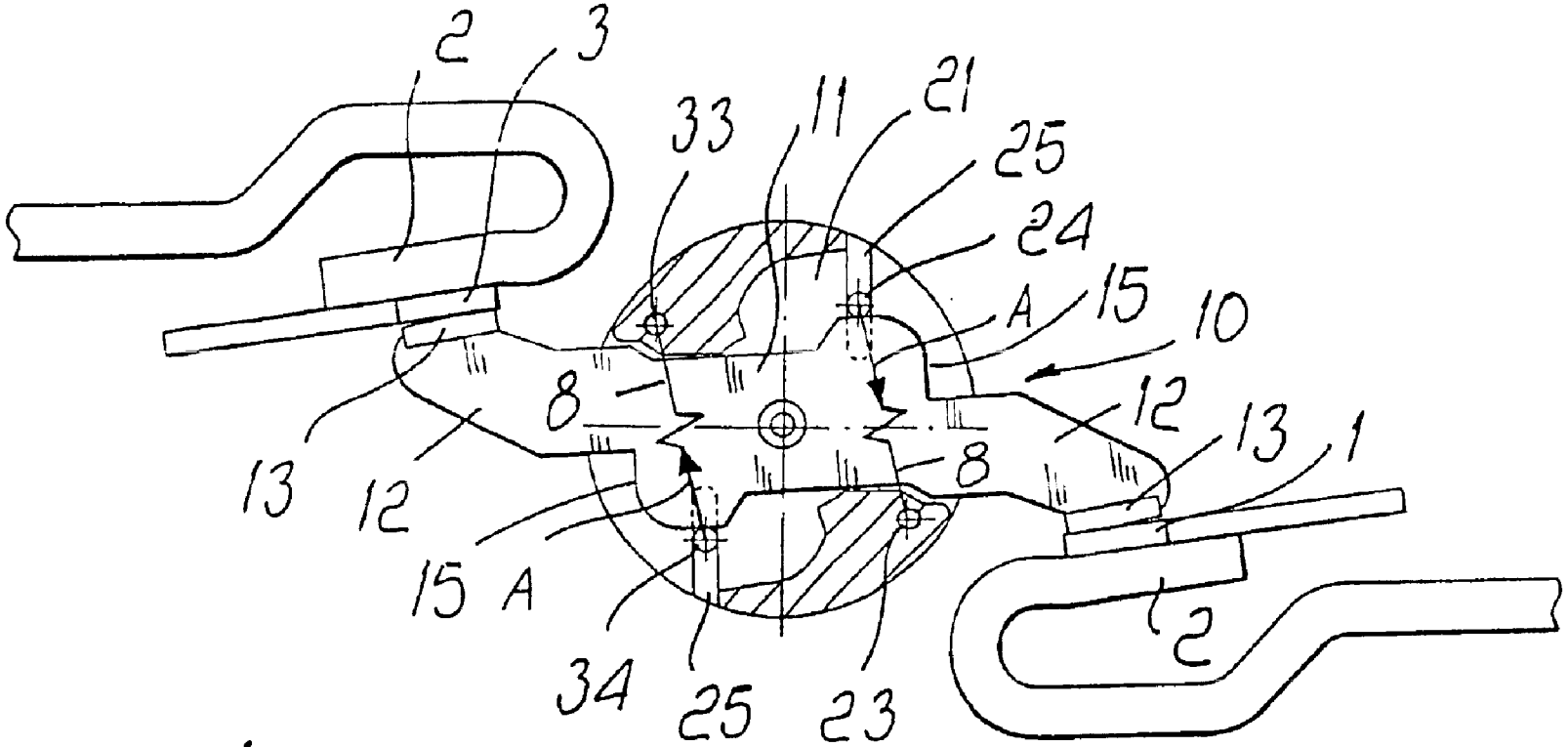
FIG. 7 is a plan view of another embodiment of the assembly constituted by the moving contact, the contact supporting shaft and the fixed contacts, for a circuit breaker with double contacts.
Figure 8:
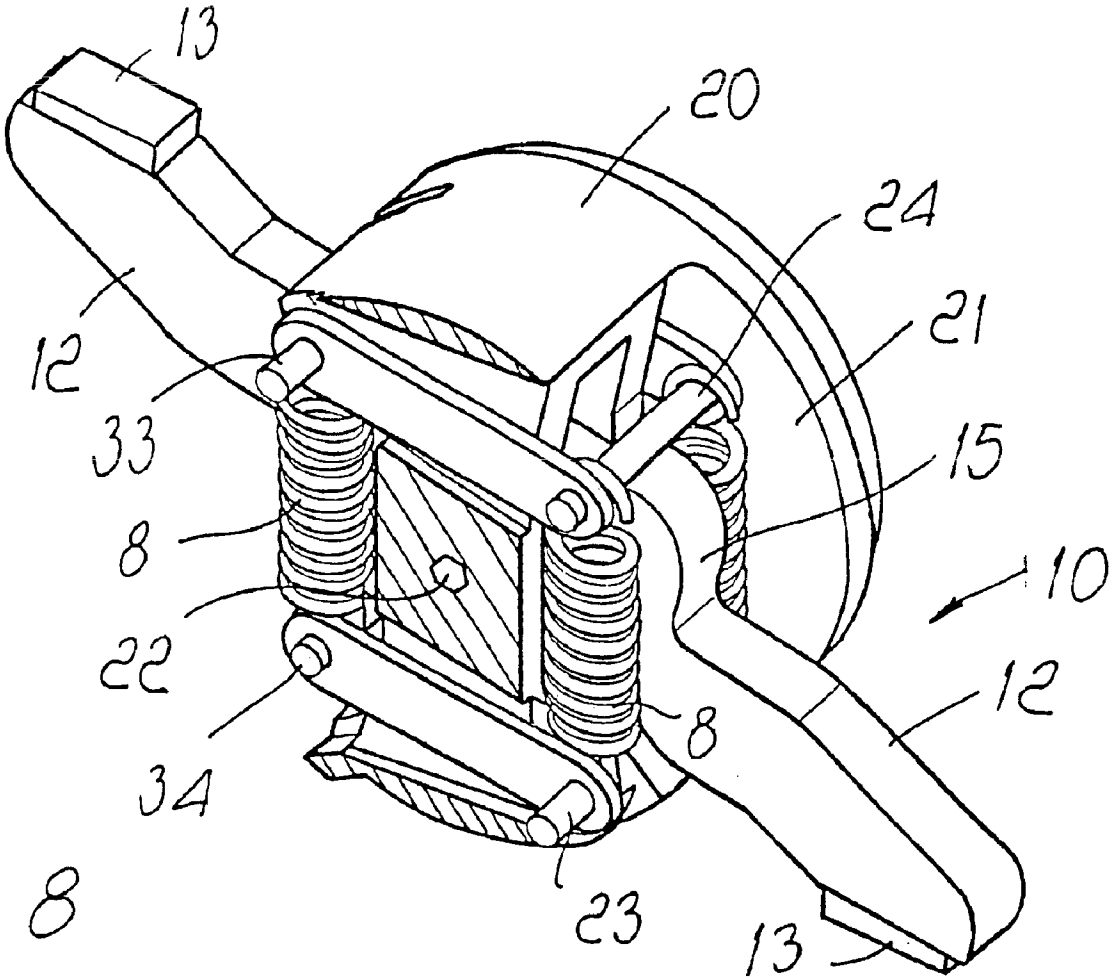
FIG. 8 is a perspective view of another possible embodiment of the assembly constituted by the moving contact and the contact supporting shaft, for a circuit breaker with double contacts.

Examples in this regard are shown in FIGS. 7 and 8. As shown for example in FIG. 7, the circuit breaker is provided with a first fixed contact 1 and with a second fixed contact 3, which are connected electrically, by means of appropriately configured conductors 2, to corresponding terminals for connection to an electrical circuit. In turn, the rotating moving contact 10 has a contoured central body 11, from which two arms 12 protrude. Said arms are substantially symmetrical with respect to said central body and therefore to the rotation axis, and two active surfaces 13 are arranged at the ends of said arms and on mutually opposite sides. Said active surfaces can be coupled/separated with respect to the corresponding fixed contacts 1 and 3 following the rotation of said moving contact 10. Advantageously, in this embodiment on the contoured central body 11 of the moving contact 10 there are two cam-like surfaces 15 on mutually opposite sides and substantially symmetrically with respect to the rotation axis and therefore to the bole 14. Correspondingly, with respect to the solution with single contacts, two additional pivots are furthermore arranged on the shaft 20: with reference to the pivot 22, a fourth pivot 33, which is fixed to the shaft in a substantially symmetrical position with respect to the third pivot 23, and a fifth pivot 34, which is arranged substantially symmetrically with respect to the second pivot 24 and can move with respect to the shaft 20 and to said moving contact 10. Two additional springs 8 are anchored to the two pivots 33 and 34 and are also arranged on mutually opposite sides with respect to the second arm 12. The fifth pivot 34 is coupled to the shaft 20 so that it can slide with respect to it, with its ends inserted in slots 25, and by interacting with the second cam-like surface 15 also helps to generate a moment that matches the direction of rotation of the moving contact, in a manner that is fully similar to what has been described for the interaction between the pivot 24 and the first cam-like surface 15.

Similar modifications can be adopted in passing from a single-contact circuit breaker to a double-contact circuit breaker for the embodiment shown in FIG. 2. In this case, as shown in FIG. 8, the fifth pivot 34 is in fact arranged, with respect to the pivot 22, substantially symmetrically to the second pivot 24 and is connected to the third pivot 23 by means of an additional pair of linkages 28. Furthermore, two additional traction springs 8 are anchored to the fourth pivot 33 and to said fifth pivot 34 and are arranged along two opposite sides of the moving contact 10. In this case also, the fifth pivot 34 interacts with the corresponding cam-like surface 15 and helps to generate a moment that matches the direction of rotation of the moving contact, in a manner fully similar to the one described for the interaction between the pivot 24 and the first cam-like surface 15.

In these embodiments also, the fixed pivots 23 and 33, which essentially act as engagement elements for the springs 8, can be replaced with fictionally equivalent engagement means.

In practice it has been found that the circuit breaker according to the invention fully achieves the intended aim, providing a significant series of advantages with respect to the known art.

In addition to the previously mentioned advantages, the circuit breaker according to the invention has a simple and functionally effective structure and can be used both as a standard circuit breaker and as a current limiter. In particular, from the constructive standpoint, the choice to adopt a perforated moving contact 10 and to fix the corresponding pivot 22 to the rotating shaft 20 is advantageous both in terms of manufacture and most of all in terns of assembly, which is simplified. Moreover, construction is significantly simplified further by the fact that the movable pivot 25 (and 34) interacts directly with the cam-like surface, without interposing any additional component and according to a solution that is functionally ideal. As an alternative, it is still possible to adopt a constructive solution in which a component, for example a small roller, is interposed between a movable pivot and the corresponding cam-like profile.

Finally, in the case of a moving contact with two arms, the contact 10 is fitted on the shaft 20 by coupling, with play, the bole 14 and the pivot 22. This allows limiting the radial strokes of said moving contact, allowing, by virtue of the particular arrangement of the pivots and of the springs, self-adaptation of the contact 10 with respect to the fixed contacts and a balanced distribution of the mechanical pressure that the active surfaces of the moving contact apply to the corresponding fixed contacts. This allows compensating effectively for any uneven wear of the contacts and leads to benefits both in terms of electrical conductivity of the circuit breaker and in terms of durability and reliability.

The circuit breaker thus conceived is susceptible of numerous modifications and variations, all of which are within the scope of the inventive concept; all the details may furthermore be replaced with other technically equivalent elements. In practice, the materials employed, as well as the dimensions, may be any according 10 the requirements and the state of the art.

What is claimed is:

1. A low-voltage circuit breaker, comprising:

at least one first fixed contact, which is electrically connected to a terminal for connection to an electric circuit;

a rotating moving contact, which comprises a central body from which at least one first arm protrudes, an active surface being provided at the end of said first arm, said active surface being associable/separable with respect to said fixed contact by means of a rotation of said moving contact, at least one first cam-like surface being formed on said central body;

a rotating contact supporting shaft, which is functionally connected to an actuation mechanism of the circuit breaker and is provided with a seat that accommodates the central body of the moving contact so that the first arm protrudes externally from said seat, at least one first spring and one second spring being furthermore arranged in said contact supporting shaft and being suitable to ensure, when the circuit breaker is closed, an adequate contact pressure between said active surface and the fixed contact; characterized in that a first pivot is fixed to said contact supporting shaft and is coupled to a hole formed in said central body, engagement means and at least one second pivot being furthermore arranged on said shaft on mutually opposite sides with respect to the first pivot, said second pivot being movable with respect to the shaft and to the moving contact, said first and second springs being furthermore anchored to the second pivot and to the engagement means and being arranged along two opposite sides of the arm of the moving contact, said second pivot interacting functionally with said first cam-like surface so as to generate a mechanical moment that matches the direction of rotation of the moving contact during at least one portion of the step for separation of the active surface from the fixed contact in a short-circuit condition.

2. The circuit breaker according to claim 1, characterized in that said second pivot interacts functionally with the corresponding cam-like surface so as to produce, during the separation of the active surface of the moving contact from the fixed contact in the short-circuit condition, a mechanical moment that is orientated oppositely with respect to the direction of rotation of the moving contact during a first portion of said separation step and a mechanical moment that matches the direction of rotation of the moving contact during a second portion of said separation step.

3. The circuit breaker according to claim 2, characterized in that said second pivot is rested in abutment directly on the cam-like surface.

4. The circuit breaker according to claim 1, characterized in that said second pivot is rested in abutment directly on the cam-like surface.

5. The circuit breaker according to claim 1, characterized in that said second pivot is coupled to the contact supporting shaft so that it can slide in slots formed in said shaft.

6. The circuit breaker according to claim 1, characterized in that said engagement means comprise a third pivot, which is fixed to the shaft, and in that it comprises at least one fourth pivot, which is fixed to the shaft in a substantially symmetrical position with respect to the third pivot relative to said first pivot, said second and fourth pivots being mutually connected by means of a first linkage and a second linkage, which are arranged in said seat of the shaft along two opposite sides of the moving contact.

7. The circuit breaker according to claim 1, characterized in that it comprises a second fixed contact, which is connected electrically to a corresponding terminal for connection to an electric circuit, and in that said rotating moving contact comprises a second arm, which protrudes from the central body and is substantially symmetrical relative to the first arm with respect to the rotation axis, a second active surface being provided at the end of said second arm, said second active surface being associable/separable with respect to said second fixed contact by means of a rotation of said moving contact, a second cam-like surface being furthermore provided on said central body and being arranged substantially symmetrically with respect to the first cam-like surface relative to said rotation axis, a fifth pivot being arranged in a position that is substantially symmetrical to the second pivot relative to the first pivot and being movable with respect to the shaft and to said moving contact, a third spring and a fourth spring being anchored to the fourth and fifth pivots and being arranged along two opposite sides of the moving contact, the fifth pivot interacting functionally with the second cam-like surface so as to help to generate a mechanical moment that matches the direction of rotation of the moving contact during at least one final portion of the step for the separation of the active surfaces from the corresponding fixed contacts in a short-circuit condition.

8. The circuit breaker according to claim 7, characterized in that said third and fifth pivots are mutually connected by means of a third linkage and a fourth linkage; which are arranged in said seat of the shaft along said two opposite sides of the moving contact.

9. The circuit breaker according to claim 7, characterized in that said fifth pivot is coupled to the contact supporting shaft so that it can slide in slots formed in said shaft.

* * * * *